US012419349B2

(12) United States Patent
Austin et al.

(10) Patent No.: US 12,419,349 B2
(45) Date of Patent: Sep. 23, 2025

(54) AEROSOL DELIVERY COMPONENT HAVING AN AIR BLEED CHANNEL

(71) Applicant: Imperial Tobacco Limited, Bristol (GB)

(72) Inventors: Andrew Austin, Liverpool (GB); Andrew Tyler, Liverpool (GB); Tamas Sajtos, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 369 days.

(21) Appl. No.: 17/916,018

(22) PCT Filed: Mar. 26, 2021

(86) PCT No.: PCT/EP2021/058051
§ 371 (c)(1),
(2) Date: Sep. 29, 2022

(87) PCT Pub. No.: WO2021/198119
PCT Pub. Date: Oct. 7, 2021

(65) Prior Publication Data

US 2023/0172265 A1 Jun. 8, 2023

(30) Foreign Application Priority Data

Mar. 30, 2020 (EP) ..... 20166747

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/10; A24F 40/40; A24F 40/42; A24F 40/485
See application file for complete search history.

(56) References Cited

U.S. PATENT DOCUMENTS 11,470,878 B1 * 10/2022 Dargan ..... A24F 40/46
11,504,486 B2 * 11/2022 Gallagher ..... A61M 11/042
11,723,409 B2 * 8/2023 Mironov ..... A24F 40/48 131/328
12,063,971 B2 * 8/2024 Austin ..... A24F 40/30
(Continued)

FOREIGN PATENT DOCUMENTS

EP 4 054 360 9/2022
WO 2015/114328 A1 8/2015
(Continued)

*Primary Examiner* — Hae Moon Hyeon
(74) *Attorney, Agent, or Firm* — Dykema Gossett PLLC

(57) ABSTRACT

The present disclosure relates to an aerosol delivery component comprising a tank defining a storage chamber for storing a first liquid aerosol precursor and an air bleed channel extending from an outside channel opening outside of the tank to an inside channel opening within the tank. The air bleed channel comprises an s-bend channel for retaining the first liquid aerosol precursor in an inverted orientation of the component. In this way, the air bleed channel may have a volume greater than 1% e.g. greater than 10% of the volume of the storage chamber.

20 Claims, 6 Drawing Sheets

(56) References Cited

U.S. PATENT DOCUMENTS

| | | | | |
|---|---|---|---|---|
| 12,075,835 | B2 * | 9/2024 | Austin | A24F 40/10 |
| 12,082,611 | B2 * | 9/2024 | Austin | A24F 40/60 |
| 12,089,647 | B2 * | 9/2024 | Potter | A24F 40/485 |
| 12,108,798 | B2 * | 10/2024 | Batista | A24F 7/02 |
| 2016/0324216 | A1 * | 11/2016 | Li | A24F 40/42 |
| 2018/0177958 | A1 * | 6/2018 | Wilder | A61M 15/0021 |
| 2020/0128874 | A1 * | 4/2020 | Atkins | A24F 40/42 |
| 2022/0071289 | A1 * | 3/2022 | Lord | A24F 40/44 |
| 2022/0142257 | A1 * | 5/2022 | Austin | A24F 40/30 |
| 2022/0256922 | A1 * | 8/2022 | Atkins | A24F 40/46 |
| 2023/0116576 | A1 * | 4/2023 | Austin | A24F 40/30 131/330 |

FOREIGN PATENT DOCUMENTS

| | | | |
|---|---|---|---|
| WO | 2016/179376 | A1 | 11/2016 |
| WO | 2017/207416 | A1 | 12/2017 |
| WO | 2021/092063 | A1 | 5/2021 |

* cited by examiner

AEROSOL DELIVERY COMPONENT HAVING AN AIR BLEED CHANNEL

FIELD OF THE INVENTION

The present invention relates to an aerosol delivery component and system, and particularly, although not exclusively, to an aerosol delivery component/system configured to reduce leakage of a liquid aerosol precursor.

BACKGROUND

One form of an aerosol delivery device is a smoking-substitute system, which is an electric system that permits the user to simulate the act of smoking by producing an aerosol or vapour that is drawn into the lungs through the mouth and then exhaled. The inhaled aerosol or vapour typically bears nicotine and/or other flavourings without the odour and health risks associated with traditional smoking and tobacco products. In use, the user experiences a similar satisfaction and physical sensation to those experienced from a traditional smoking or tobacco product, and exhales an aerosol or vapour of similar appearance to the smoke exhaled when using such traditional smoking or tobacco products.

One approach for a smoking substitute system is the so-called "vaping" approach, in which a vaporisable liquid, typically referred to (and referred to herein) as "e-liquid", is heated by a heating element to produce an aerosol/vapour which is inhaled by a user. The e-liquid typically includes a base liquid as well as nicotine and/or flavourings. The resulting vapour therefore also typically contains nicotine and/or flavourings. The base liquid may include propylene glycol and/or vegetable glycerine.

A typical vaping smoking substitute system includes a mouthpiece, a power source (typically a battery), a tank for containing e-liquid, as well as a heating element. In use, electrical energy is supplied from the power source to the heating element, which heats the e-liquid to produce an aerosol (or "vapour") which is inhaled by a user through the mouthpiece.

Vaping smoking substitute systems can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a device which includes the power source, wherein the device is configured to be physically and electrically coupled to a consumable including the tank and the heating element. The consumable may also be referred to as a cartomizer. In this way, when the tank of a consumable has been emptied, the consumable is disposed of. The device can be reused by connecting it to a new, replacement, consumable. Another subset of closed system vaping smoking substitute systems are completely disposable, and intended for one-use only.

There are also "open system" vaping smoking substitute systems which typically have a tank that is configured to be refilled by a user. In this way the system can be used multiple times.

An example vaping smoking substitute system is the Myblu® system. The Myblu® system is a closed system which includes a device and a consumable. The device and consumable are physically and electrically coupled together by pushing the consumable into the device. The device includes a rechargeable battery. The consumable includes a mouthpiece, a sealed tank which contains e-liquid, as well as a heating element, which for this system is a heating filament coiled around a portion of a wick. The wick is partially immersed in the e-liquid, and conveys e-liquid from the tank to the heating filament. The system is activated when a microprocessor on board the device detects a user inhaling through the mouthpiece. When the system is activated, electrical energy is supplied from the power source to the heating element, which heats e-liquid from the tank to produce a vapour which is inhaled by a user through the mouthpiece.

For a smoking substitute system it is desirable to deliver nicotine into the user's lungs, where it can be absorbed into the bloodstream. As explained above, in the vaping approach, e-liquid is heated by a heating element to produce an aerosol/vapour which is inhaled by a user.

Many e-cigarettes also deliver flavour to the user, to enhance the experience. Flavour compounds are contained in the e-liquid that is heated. Heating of the flavour compounds may be undesirable as the flavour compounds are inhaled into the user's lungs. Toxicology restrictions are placed on the amount of flavour that can be contained in the e-liquid. This can result in some e-liquid flavours delivering a weak and underwhelming taste sensation to consumers in the pursuit of safety.

In aerosol delivery devices comprising a sealed tank containing a liquid aerosol precursor e.g. an e-liquid or a flavoured aerosol precursor, it may be desirable to provide a bleed channel extending between an inside and an outside of the tank in order to allow a bleed of air into the tank to avoid a vacuum build up as the volume of liquid aerosol precursor within the tank reduces. Any reduction of pressure within the tank may inhibit effective delivery of the liquid aerosol precursor for aerosolisation.

The provision of an air bleed channel may render the tank prone to leakage as the bleed channel provides a passage for the liquid aerosol precursor from the tank, especially when the tank is in an inverted position with the inside bleed channel opening vertically higher than the outside bleed channel opening. This problem is exacerbated where there is an accompanying change in temperature of the tank e.g. when the tank is held within a user's pocket, as any expansion in the volume of the trapped air within the tank is likely to force the liquid to exit the outside bleed channel opening and thus contaminate the user.

The present invention has been devised in light of the above considerations.

SUMMARY OF THE INVENTION

According to a first aspect there is provided an aerosol delivery component comprising:

- a tank defining a storage chamber for storing a first liquid aerosol precursor,
- an air bleed channel extending from an outside channel opening outside of the tank to an inside channel opening within the tank,
- wherein the air bleed channel comprises an s-bend channel for retaining the first liquid aerosol precursor in an inverted orientation of the component.

According to a second aspect, there is provided an aerosol delivery component comprising:

- a tank defining a storage chamber for storing a first liquid aerosol precursor,
- an air bleed channel extending from an outside channel opening outside of the tank to an inside channel opening within the tank, wherein the air bleed channel has a volume of at least 1% of the volume of the storage chamber.

By providing an air bleed channel having an s-bend configuration (which will typically have an increased volume compared to a substantially linear bleed channel) and/or providing an air bleed channel having a volume of at least 1% of the storage chamber, leakage of liquid aerosol precursor (e.g. e-liquid or liquid flavourant) from the tank when the component is in an inverted orientation (i.e. when the outside channel opening is vertically lower than the inside channel opening) is reduced as the liquid can be retained within the increased volume of the air bleed channel. Changes in the volume of the air trapped within the tank (e.g. due to a change in the temperature of the air or due to placing of the component within a user's pocket) can be accommodated without leakage of liquid from the outside channel opening because the liquid can rise further within the air bleed channel (until the pressure inside and outside the tank is equalised) without reaching the outside channel opening.

The air bleed channel of the first aspect may have a volume of at least 1% of the volume of the storage chamber.

The air bleed channel of the second aspect may comprise an s-bend channel for retaining the first liquid aerosol precursor in an inverted orientation of the component.

Optional features of the first and second aspects will now be set out. These are applicable singly or in any combination with any aspect.

An s-bend channel typically comprises two vertically spaced bend portions. The bend portions preferably each have a smooth, continuous deflection (e.g. a 180 degree deflection)) such that the channel has an s-shaped profile. The two bend portions may be vertically spaced by a linear portion.

The bleed channel may comprise a first bend portion comprising a deflection e.g. a 180 degree deflection proximal the inside channel opening. The bleed channel may comprise a first substantially linear portion extending from the first bend portion to a crown portion. The crown portion may comprise a second bend portion comprising a deflection e.g. a 180 degree deflection.

In the inverted position, the crown portion may be vertically higher than the first bend portion.

The bleed channel may comprise a second substantially linear portion extending from the crown portion to the outside channel opening In this way, in an upright use orientation, air may enter the storage chamber to equalise the pressure in the tank to account for the reduction in volume of the first liquid aerosol precursor. The air flow path from the outside channel opening to the inside channel opening in the upright (use) orientation extends in an upstream direction to the crown portion and then in a downstream direction to the first bend portion before entering the storage chamber at the inside channel opening.

Upon inversion of the component, first liquid aerosol precursor will enter the bleed channel through the inside channel opening and will extend within the channel e.g. within the first bend portion and first linear portion. In the event of a temperature increase (e.g. an increase in temperature of up to 20° C. as may occur when the component is held within a user's pocket) or an environmental pressure decrease, the increase in volume of the first liquid aerosol precursor within the bleed channel (resulting from an increase in volume in the air trapped within the storage chamber/tank) can be accommodated e.g. within the crown portion/second linear portion.

In some embodiments, the air bleed channel is a capillary channel. In this way, surface tension assists in the retention of the first liquid aerosol precursor within the second linear portion.

The linear portions may be substantially parallel to one another. They may be substantially parallel to the longitudinal axis of the component.

In the inverted orientation of the component, the crown portion may be vertically spaced above the inside channel opening.

The air bleed channel (e.g. the s-bend air bleed channel) may have a volume greater than 2% or 3% of the volume of the storage chamber. For example, the air bleed channel (e.g. the s-bend air bleed channel) may have a volume greater than 5% or 6% such as greater than 7% or 10% of the volume of the storage chamber. The air bleed channel (e.g. the s-bend air bleed channel) may have a volume greater than 11% of the volume of the storage chamber. The air bleed channel (e.g. the s-bend air bleed channel) may have a volume up to 20% e.g. up to 15% or up to 12% greater than the volume of the storage chamber.

The volume of the storage chamber is taken to be the volume suitable for accommodating the liquid aerosol precursor (which may be a reduced volume compared to the volume of the tank).

The aerosol delivery component may be a smoking substitute component (e.g. an e-cigarette component).

The aerosol delivery component may be a consumable part of an aerosol delivery system e.g. a consumable for a smoking substitute system. In this regard, the component may be a termed "a consumable".

The aerosol delivery component may comprise a flow passage for fluid flow therethrough. The flow passage may extend generally in a longitudinal direction between (and may fluidly connect) an inlet to an outlet aperture of the aerosol delivery component at a downstream end of the flow passage. The outlet aperture may be provided in a mouthpiece of the component and may therefore hereinafter be described as a mouthpiece aperture. In this respect, a user may draw fluid (e.g. air) into and through the flow passage by inhaling at the mouthpiece aperture.

The terms "upstream" and "downstream" are used with reference to the direction of airflow (from inlet to outlet) through the component during normal use of the component (i.e. by way of inhalation at the mouthpiece aperture). Similarly, the terms "upper" and "lower" are used with reference to the component during normal use (i.e. an upright orientation (i.e. with the outside channel opening vertically higher than the inside channel opening)).

The air bleed channel may be in fluid communication with the flow passage, i.e. the outside channel opening may open to the flow passage. In this way, air from the flow passage can enter the storage chamber through the air bleed channel when the component is in the upright orientation.

The aerosol delivery component comprises a tank defining a storage chamber for containing the first aerosol precursor. The first aerosol precursor may be a liquid flavourant or an e-liquid. For example, it may comprise a liquid flavourant having a menthol, liquorice, chocolate, fruit flavour (including e.g. citrus, cherry etc.), vanilla, spice (e.g. ginger, cinnamon) and/or tobacco flavour.

The first aerosol precursor may be stored in the form of a free liquid. Alternatively, a porous body may be disposed within the storage chamber, which may contain the first aerosol precursor.

The tank may at least partially define the flow passage. For example, the flow passage may be defined between an outer surface of the tank and an inner surface of a component housing (which may be integral with the mouthpiece).

The tank may further comprise an upper wall extending transverse to the longitudinal axis of the component and in which the inside and outside channel openings are formed. The first bend portion may also be formed within the tank upper wall.

The aerosol delivery component may comprise an aerosol generator in the form of a porous liquid transfer element (i.e. formed of a porous material). As will be described further below, the liquid transfer element may be configured to generate the first aerosol in the flow passage.

The liquid transfer element may comprise a conveying portion and an aerosol generating portion. The conveying portion may be elongate and generally cylindrical, and may be at least partially enclosed within one or more internal walls of the aerosol delivery component. The one or more internal walls enclosing the conveying portion may form part of the tank defining the storage chamber. In this respect, the tank may at least partly surround (e.g. may fully surround) the conveying portion of the liquid transfer element. That is, the tank may define a conduit extending from the tank upper wall through which the conveying portion passes. Thus, the conveying portion may extend generally longitudinally (e.g. centrally) through a portion of the tank (i.e. through the conduit defined by the tank).

The first and second linear portions of the air bleed channel may extend substantially parallel to the conveying portion of the liquid transfer element/conduit. They may have a longitudinal length substantially matching that of the conduit such that the crown portion of the bleed channel may be substantially aligned in a horizontal direction with the upstream end of the conduit.

The outside channel opening may be radially outwards of the inside channel opening. The outside channel opening may be distal the liquid transfer element i.e. it may be radially closer to the outside surface of the tank/component housing walls than to the liquid transfer element.

The liquid transfer element may be supported in the aerosol delivery component by the mouthpiece. That is, the mouthpiece may comprise a collar for holding (and gripping) the liquid transfer element in position within the aerosol delivery component.

The aerosol generating portion of the liquid transfer element may be disposed at a downstream end of the conveying portion and may thus define a downstream longitudinal end of the liquid transfer element. The aerosol generating portion may be at least partly located in the flow passage so as to be exposed to airflow within the flow passage. In particular, the aerosol generating portion of the liquid transfer element may extend into an aerosolisation chamber forming part of the flow passage. The aerosolisation chamber may be located proximate to (and in fluid communication with) the mouthpiece aperture of the component. Airflow through the flow passage may pass across or through the aerosol generating portion of the liquid transfer element prior to being discharged through the mouthpiece aperture.

The aerosol generating portion may define an enlarged (e.g. radially enlarged) portion of the liquid transfer element. For example, the aerosol generating portion may be bulb-shaped or bullet-shaped, and may comprise a portion which is wider than the conveying portion. The aerosol generating portion may taper (inwardly) to a tip at a downstream end of the aerosol generating portion (i.e. proximate the outlet/mouthpiece aperture). The aerosol-generating portion may have a flattened downstream end surface.

The liquid transfer element may extend into the storage chamber so as to be in contact with (e.g. at least partially submerged in) the first aerosol precursor. In this way, the liquid transfer element may be configured to convey (e.g. via a wicking/capillary action) the first aerosol precursor from the storage chamber to the aerosolisation chamber. As will be described further below, this may allow the first aerosol precursor to form an aerosol and be entrained in an airflow passing through the aerosolisation chamber (i.e. for subsequent receipt in a user's mouth).

The flow passage may be constricted (i.e. narrowed) at the aerosolisation chamber. For example, the presence of the aerosol generating portion in the flow passage may create a constricted or narrowed portion of the flow passage (because the aerosol generating portion extends partway across the flow passage). In this respect, the narrowest portion of the flow passage may be at aerosolisation chamber (adjacent to the aerosol generating portion of the liquid transfer element). This constriction of the flow passage increases the velocity of air/vapour passing through the aerosolisation chamber. In this respect, the constriction may be referred to as a Venturi aperture. The constriction may have a toroidal shape (i.e. extending about the aerosol generating portion of the liquid transfer element). The toroidal shape may, however, be interrupted by supports (e.g. projections, ribs, etc.) protruding inwardly from wall(s) of the flow passage to support the aerosol generating portion in the aerosolisation chamber.

In addition to increasing the airflow velocity, the constriction reduces the air pressure of the airflow flowing through the constriction (i.e. in the vicinity of the aerosol generating portion). This low pressure and high velocity facilitate the generation of an aerosol from the first aerosol precursor held in the aerosol generating portion (i.e. transferred from the storage chamber by the liquid transfer element). This aerosol, which is herein referred to as the first aerosol, is entrained in the airflow passing through the constriction and is discharged from the mouthpiece aperture of the aerosol delivery component.

The flow passage may comprise one or more deflections. It may comprise a transverse portion proximal the inlet such that there is a deflection between the inlet and the transverse portion of the flow passage.

The flow passage may then comprise a generally longitudinal portion downstream of the transverse portion. The longitudinal portion may extend within the spacing between the component housing (which may be integral with the mouthpiece) and the tank. The flow passage may then deflect again (e.g. radially) at the upper wall of the tank within the mouthpiece, through the aerosolisation chamber, towards the mouthpiece aperture.

The flow passage may be a single (annular) flow passage around the tank or it may comprise two branches which split around the tank and re-join within the mouthpiece proximal the liquid transfer element.

The linear portions of the bleed channel may extend (e.g. longitudinally) within the storage chamber.

The storage chamber may be an annular storage chamber. The storage chamber may comprise an elongate body e.g. extending longitudinally along an inner surface of the tank. The first and second linear portions and the crown portion of the bleed channel may extend within the elongate body. The elongate body may have a longitudinal length substantially matching that of the conveying portion of the liquid transfer element/conduit i.e. an upstream end of the elongate body may be substantially aligned in a horizontal direction with the upstream end of the conduit.

The elongate body may be integrally formed with the outer surface of the tank and/or the tank upper wall.

The above configuration of the aerosol delivery component may be representative of an activated state of the aerosol delivery component. The aerosol delivery component may additionally be configurable in a deactivated state. In the deactivated state, the liquid transfer element may be isolated from the first aerosol precursor. This isolation may, for example, be provided by a plug (e.g. formed of silicon). The plug may be located at an end (i.e. upstream end) of the conduit (defined by the tank) so as to provide a barrier between the first aerosol precursor in the storage chamber and the conveying portion of the liquid transfer element. Alternatively, the aerosol delivery component may comprise a duck bill valve, a split valve or diaphragm; or a sheet of foil isolating the liquid transfer element from the first aerosol precursor.

In the deactivated state, the air bleed channel may be sealed by a sealing element. The sealing element may, for example, be in the form of a pierceable membrane (e.g. formed of a metal foil) extending across the air bleed channel.

The aerosol delivery component may comprise a mouthpiece/component housing that is movable relative to the tank defining the storage chamber. The mouthpiece/component housing may be movable relative to the air bleed channel. In particular, movement of the mouthpiece/component housing may be in the longitudinal direction of the aerosol delivery component.

The mouthpiece may comprise an activation member, which may protrude internally from an internal surface of mouthpiece. When the mouthpiece/component housing is moved longitudinally in an upstream direction i.e. towards the storage tank, a distal end of the activation member may engage the sealing element. This movement of the sealing element may open the air bleed channel, so as to allow airflow therethrough and so as to move the aerosol delivery component to the activated state.

When the sealing element is a pierceable membrane, the activation member may pierce the pierceable membrane when moved in the upstream direction. To facilitate such piercing, the activation member may be in the form of a blade, or may be pointed.

The movement of the mouthpiece/component housing may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the first aerosol precursor (i.e. so as to be able to convey the first aerosol precursor to the aerosol generating portion of the liquid transfer element).

The components of the aerosol delivery component described above may form a passive aerosolisation portion configured to generate the first aerosol in such a way that does not use heat. Accordingly, the liquid transfer element may not use heat to form the first aerosol, and therefore in some embodiments may be referred to as a "passive" aerosol generator.

The first aerosol may be sized to inhibit pulmonary penetration. The first aerosol may be formed of particles with a mass median aerodynamic diameter that is greater than or equal to 15 microns, e.g. greater than 30 microns, or greater than 50 microns, or may be greater than 60 microns, or may be greater than 70 microns.

The first aerosol may be sized for transmission within at least one of a mammalian oral cavity and a mammalian nasal cavity. The first aerosol may be formed by particles having a maximum mass median aerodynamic diameter that is less than 300 microns, or e.g. less than 200 microns, or less than 100 microns. Such a range of mass median aerodynamic diameter can produce aerosols which are sufficiently small to be entrained in an airflow caused by a user drawing air through the aerosol delivery component and to enter and extend through the oral and or nasal cavity to activate the taste and/or olfactory receptors.

The size of aerosol formed without heating may be typically smaller than that formed by condensation of a vapour.

It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

The aerosol delivery component may further comprise an active aerosolisation portion (which may be a cartomiser) configured to use applied energy such as heat to vaporise a second liquid aerosol precursor to form a second aerosol.

The passive aerosolisation portion may be downstream of the active aerosolisation portion.

The passive aerosolisation portion may be engageable with the active aerosolisation portion (cartomizer), for example, by way of an interference fit, snap-engagement, bayonet locking arrangement, etc.

The component housing may comprise opposing apertures for engagement with respective lugs provided on the active aerosolisation portion (cartomizer) to secure the component housing to the active aerosolisation portion (cartomizer). There may be two sets of longitudinally spaced lugs and two sets of longitudinally spaced apertures with only the downstream lugs engaged within the upstream apertures when the component is in its deactivated state. Movement of the mouthpiece/component housing cases engagement of the upstream lugs in the upstream apertures and the downstream lugs in the downstream apertures.

In other embodiments, the passive aerosolisation portion and the active aerosolisation portion may be integrally formed.

The active aerosolisation portion (cartomizer) may comprise a vaporising chamber and a vapour outlet channel for fluid flow therethrough. The vapour outlet channel may be fluidly connected to the flow passage of the passive aerosolisation portion of the component i.e. to the inlet of the flow passage through the passive aerosolisation portion. The vapour outlet channel and vaporising chamber may fluidly connect a component inlet opening and the inlet of the flow passage within the passive aerosolisation portion of the component. Thus, an airflow may be drawn into and through the active aerosolisation portion, and subsequently through the passive aerosolisation portion.

The aerosol delivery component i.e. the active aerosolisation portion may comprise a reservoir defined by a container for containing a second aerosol precursor (which may be an e-liquid). The second aerosol precursor may, for example, comprise a base liquid and a physiologically active compound e.g. nicotine. The base liquid may include an aerosol former such as propylene glycol and/or vegetable glycerine.

At least a portion of the container may be translucent or transparent. For example, the container may comprise a window to allow a user to visually assess the quantity of second aerosol precursor in the container. The cartomizer may be referred to as a "clearomizer" if it includes a window. The vapour outlet channel may extend longitudinally through the container, wherein a channel wall of the vapour outlet channel may define the inner wall of the container. In this respect, the container may surround the vapour outlet channel, such that the container may be generally annular.

The aerosol delivery component i.e. the active aerosolisation portion may comprise a vaporiser. The vaporiser may be located in the vaporising chamber.

The vaporiser may comprise a wick. The vaporiser may further comprise a heater. The wick may comprise a porous material. A portion of the wick may be exposed to fluid flow in the vaporising chamber. The wick may also comprise one or more portions in contact with the second aerosol precursor stored in the reservoir. For example, opposing ends of the wick may protrude into the reservoir and a central portion (between the ends) may extend across the vaporising chamber so as to be exposed to air flow in the vaporising chamber. Thus, fluid may be drawn (e.g. by capillary action) along the wick, from the reservoir to the exposed portion of the wick.

The heater may comprise a heating element, which may be in the form of a filament wound about the wick (e.g. the filament may extend helically about the wick). The filament may be wound about the exposed portion of the wick. The heating element may be electrically connected (or connectable) to a power source. Thus, in operation, the power source may supply electricity to (i.e. apply a voltage across) the heating element so as to heat the heating element. This may cause liquid stored in the wick (i.e. drawn from the reservoir) to be heated so as to form a vapour and become entrained in fluid/air flowing through the vaporising chamber. This vapour may subsequently cool to form an aerosol in the vapour outlet channel. This aerosol is hereinafter referred to as the second aerosol. This aerosol generation may be referred to as "active" aerosol generation, because it makes use of heat to generate the aerosol.

This second aerosol may subsequently flow from the vapour outlet channel to (and through) the flow passage of the passive aerosolisation portion of the component. Thus, the fluid received through the mouthpiece aperture of the aerosol delivery component may be a combination of the first aerosol and the second aerosol.

The second aerosol generated is sized for pulmonary penetration (i.e. to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapour.

In a third aspect there is provided an aerosol delivery system (e.g. a smoking substitute system) comprising a device having a power source, and a component as described above with respect to the first or second aspect.

The component may be engageable/engaged with the device such that the vaporiser of the component/consumable is connected to the power source of the device.

For example, the active aerosolisation portion (cartomizer) may be configured for engagement with the device.

The device and the component (e.g. the active aerosolisation portion of the consumable) may be configured to be physically coupled together. For example, the component may be at least partially received in a recess of the device, such that there is snap engagement between the device and the component. Alternatively, the device and the component may be physically coupled together by screwing one onto the other, or through a bayonet fitting.

Thus, the component may comprise one or more engagement portions for engaging with a device. In this way, one end of the component (i.e. the end of the active aerosolisation component comprising the component inlet) may be coupled with the device, whilst an opposing end (i.e. the end of the passive aerosolisation component comprising the outlet aperture) of the component may define the mouthpiece.

The device or the component may comprise a power source or be connectable to a power source. The power source may be electrically connected (or connectable) to the heater. The power source may be a battery (e.g. a rechargeable battery). An external electrical connector in the form of e.g. a USB port may be provided for recharging this battery.

The component may comprise an electrical interface for interfacing with a corresponding electrical interface of the device. One or both of the electrical interfaces may include one or more electrical contacts. Thus, when the device is engaged with the component, the electrical interface may be configured to transfer electrical power from the power source to a heater of the component. The electrical interface may also be used to identify the component from a list of known types. The electrical interface may additionally or alternatively be used to identify when the component is connected to the device.

The device may alternatively or additionally be able to detect information about the consumable via an RFID reader, a barcode or QR code reader. This interface may be able to identify a characteristic (e.g. a type) of the component. In this respect, the component may include any one or more of an RFID chip, a barcode or QR code, or memory within which is an identifier and which can be interrogated via the interface.

The device may comprise a controller, which may include a microprocessor. The controller may be configured to control the supply of power from the power source to the heater (e.g. via the electrical contacts). A memory may be provided and may be operatively connected to the controller. The memory may include non-volatile memory. The memory may include instructions which, when implemented, cause the controller to perform certain tasks or steps of a method.

The device may comprise a wireless interface, which may be configured to communicate wirelessly with another device, for example a mobile device, e.g. via Bluetooth®. To this end, the wireless interface could include a Bluetooth® antenna. Other wireless communication interfaces, e.g. WiFi®, are also possible. The wireless interface may also be configured to communicate wirelessly with a remote server.

An airflow (i.e. puff) sensor may be provided that is configured to detect a puff (i.e. inhalation from a user). The airflow sensor may be operatively connected to the controller so as to be able to provide a signal to the controller that is indicative of a puff state (i.e. puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the component or the device.

In some embodiments, the aerosol delivery component may be a non-consumable component in which one or both of the first and second aerosol precursors of the component may be replenished by re-filling the reservoir or storage chamber of the component (rather than replacing the consumable component). In this embodiment, the component described above may be integral with the device. For example, the only consumable portion may be the first and/or second aerosol precursor contained in reservoir and storage chamber of the component. Access to the reservoir and/or storage chamber (for re-filling of the aerosol precursor) may be provided via e.g. an opening to the reservoir and/or storage chamber that is sealable with a closure (e.g. a cap).

In a fourth aspect there is provided a method of using a smoking substitute system as described above with respect to the third aspect, the method comprising engaging the component with the device so as to connect the vaporiser of the component with the power source of the device.

The method may comprise engaging the passive aerosolisation portion of the component (e.g. flavour pod) with the active aerosolisation portion of the component (e.g. cartomizer) such that the flow passage of the passive aerosolisation portion is in fluid communication with the vapour outlet channel of the active aerosolisation portion.

The invention includes the combination of the aspects and preferred features described except where such a combination is clearly impermissible or expressly avoided.

SUMMARY OF THE FIGURES

So that the invention may be understood, and so that further aspects and features thereof may be appreciated, embodiments illustrating the principles of the invention will now be discussed in further detail with reference to the accompanying figures, in which.

DETAILED DESCRIPTION OF THE INVENTION

Aspects and embodiments of the present invention will now be discussed with reference to the accompanying figures. Further aspects and embodiments will be apparent to those skilled in the art.

Figure 1A:
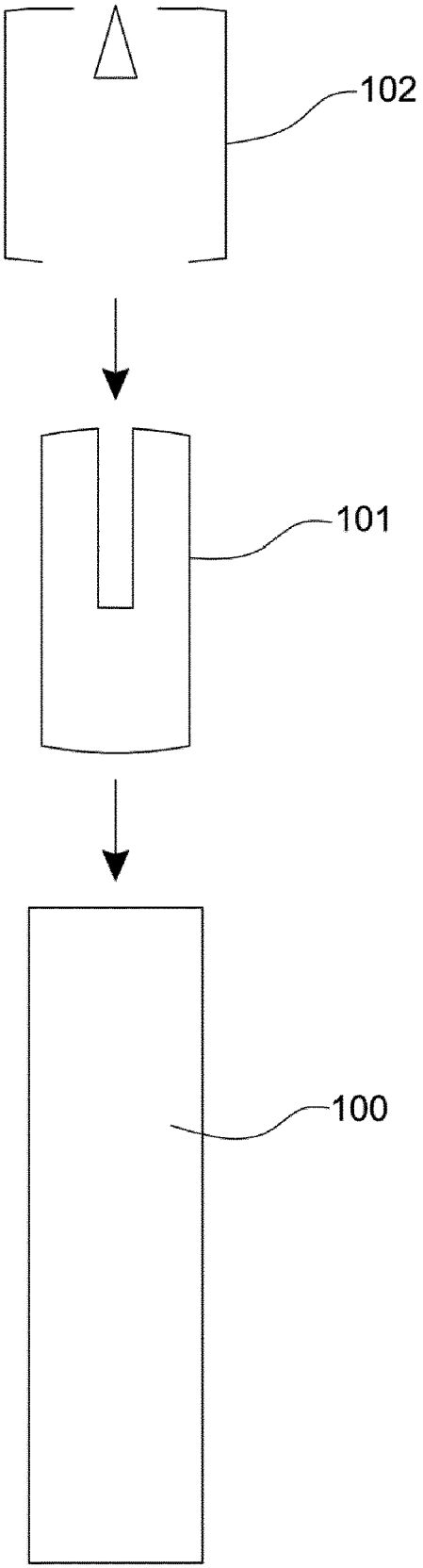
FIGS. 1A and 1B is a schematic drawing of an aerosol delivery system according to a first embodiment.
Figure 1B:
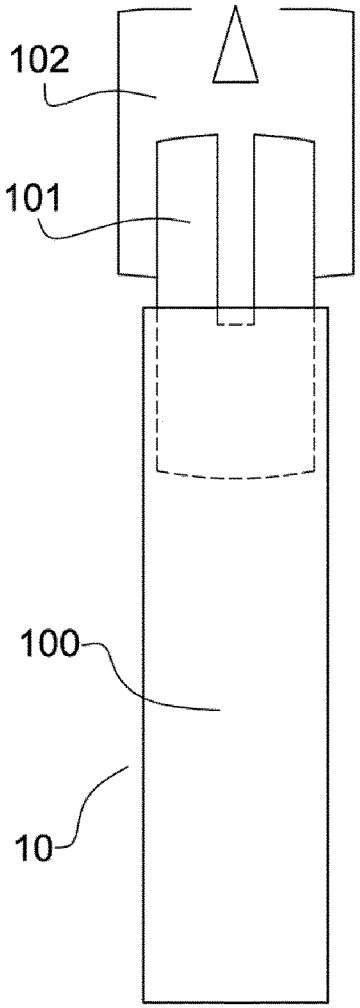

Referring to FIGS. 1A and 1B, there is shown a schematic view of an aerosol delivery system in the form of a smoking substitute system 10. In this example, the smoking substitute system 10 comprises an active aerosolisation portion in the form of cartomizer 101 and a passive aerosolisation portion in the form of flavour pod 102 connected to a device 100. In this example, the device 100 includes elements of the smoking substitute system 10 such as a battery, an electronic controller, and a pressure transducer (not shown). The cartomizer 101 may engage with the device 100 via a push-fit engagement, a screw-thread engagement, or a bayonet fit, for example.

The flavour pod 102 is configured to engage with the cartomizer 101 and thus with the device 100. The flavour pod 102 may engage with the cartomizer 101 via a push-fit engagement, a screw-thread engagement, or a bayonet fit, for example. FIG. 1B illustrates the cartomizer 101 engaged with the device 100, and the flavour pod 102 engaged with the cartomizer 101. As will be appreciated, in this example, the cartomizer 101 and the flavour pod 102 are distinct elements.

As will be appreciated from the following description, in other embodiments the cartomizer 101 and the flavour pod 102 may be combined into a single integrated component that implements the combined functionality of the cartomizer 101 and flavour pod 102. In other examples, the cartomizer may be absent, with only a flavour pod 102 present.

As is set forth above, reference to a "consumable" component may mean that the component is intended to be used once until exhausted, and then disposed of as waste or returned to a manufacturer for reprocessing.

Figure 2A:
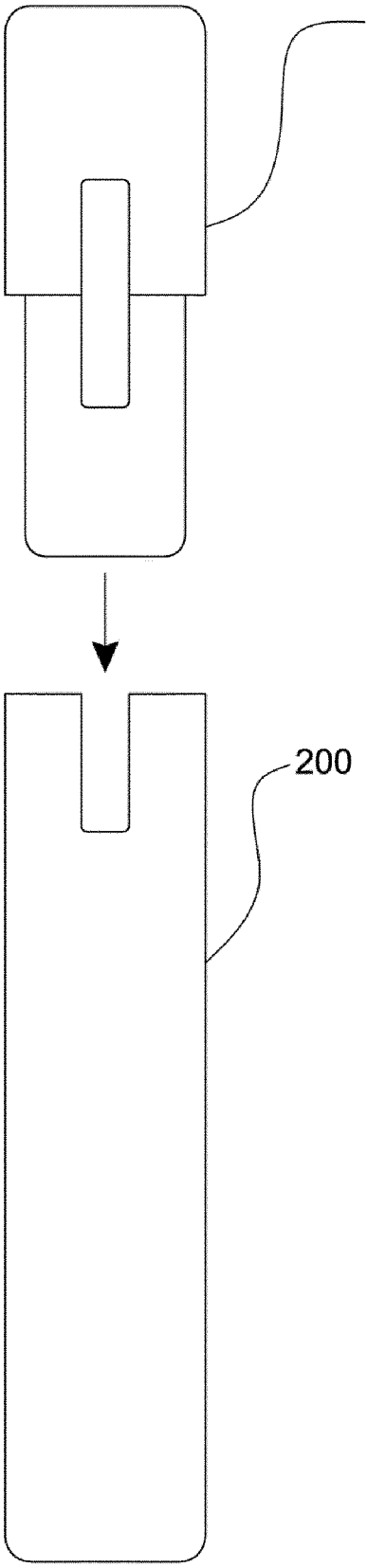
FIGS. 2A and 2B is a schematic drawing of an aerosol delivery system according to a second embodiment.
Figure 2B:
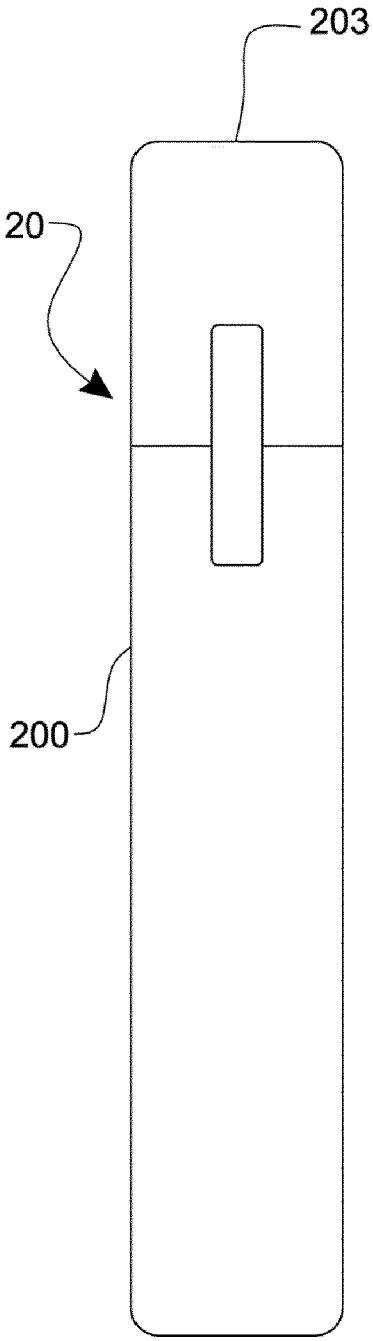

Referring to FIGS. 2A and 2B, there is shown a smoking substitute system 20 comprising a device 200 and a consumable component 203. The consumable component 203 combines the functionality of the active aerosolisation portion (cartomizer 201) and the passive aerosolisation portion (flavour pod 202). In FIG. 2A, the consumable component 203 and the device 200 are shown separated from one another. In FIG. 2B, the consumable component 203 and the device 200 are engaged with each other to form the smoking substitute system 20.

Figure 3A:
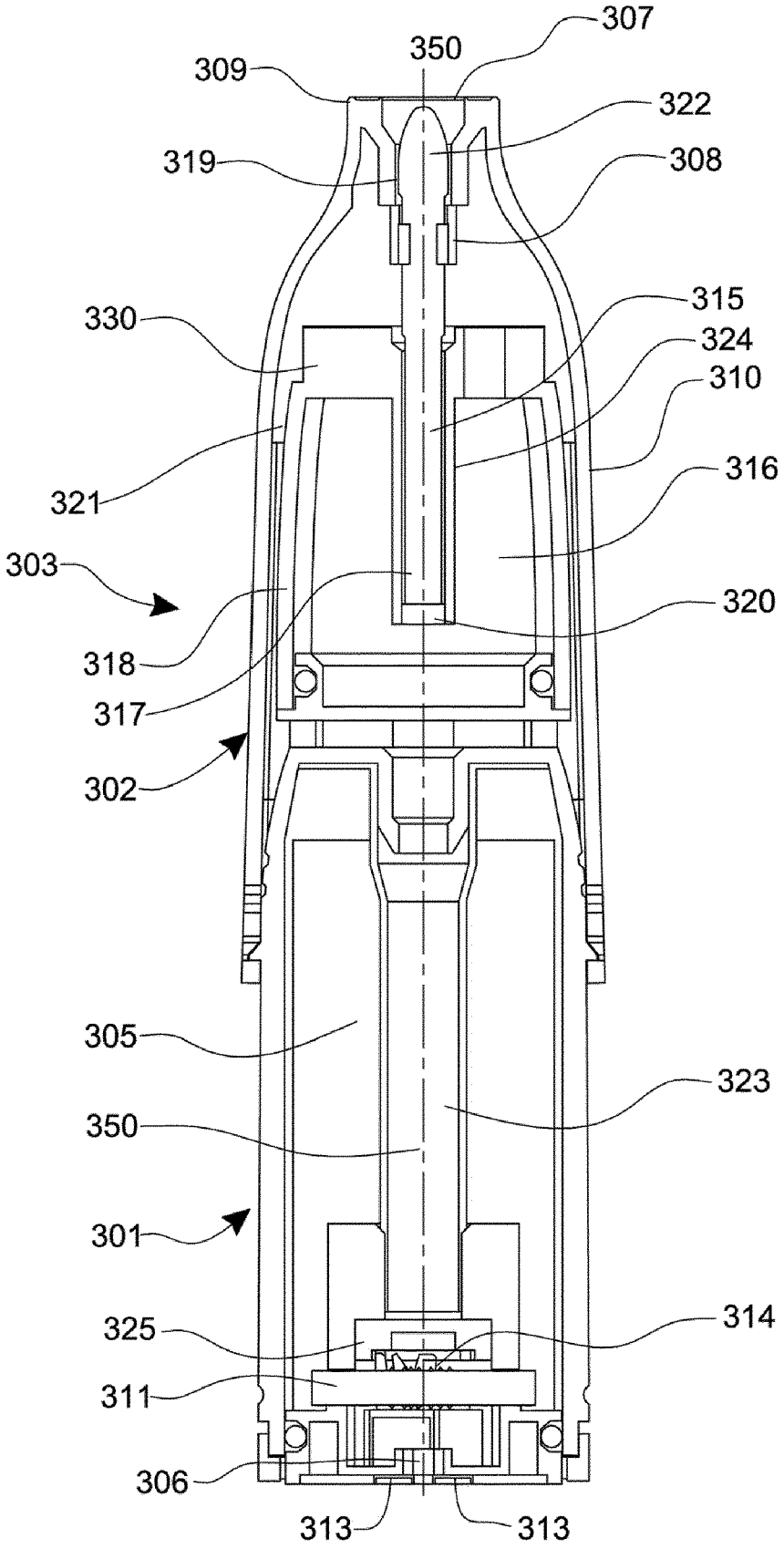
FIG. 3A is a cross-sectional view of a consumable, according to a third embodiment, in a deactivated state.

Referring to FIG. 3A, there is shown a consumable component 303 engageable with a device (not shown) via a push-fit engagement. The consumable component 303 is shown in a deactivated state. The consumable component 303 may be considered to have two portions—an active aerosolisation (cartomizer) portion 301 and a passive aerosolisation (flavour pod) portion 302, both of which are located within a single consumable component 303 (as in FIGS. 2A and 2B). It should, however, be appreciated that in a variation, the cartomizer portion 301 and flavour pod portion 302 may be separate (but engageable) portions.

The consumable component 303 includes an upstream component inlet opening 306 and a downstream mouthpiece aperture 307 (i.e. defining an outlet of the consumable component 303). In other examples, a plurality of inlets and/or outlets are included. Between, and fluidly connecting, the component inlet opening 306 and the mouthpiece aperture 307 there is an airflow passage comprising (in a downstream flow direction) a vaporising chamber 325 of the cartomizer portion 301, a vapour outlet channel 323 (also within the cartomizer portion 301) and a downstream flow passage 321 (which will hereinafter be referred to as the vapour flow passage 321) of the flavour pod portion 302. The mouthpiece aperture 307 is located at the mouthpiece 309 of the consumable component 303.

As above, the consumable component 303 includes a passive aerosolisation (flavour pod) portion 302. The flavour pod portion 302 is configured to generate a first (flavoured) aerosol for output from the mouthpiece aperture 307. The flavour pod portion 302 of the consumable component 303 includes a liquid transfer element 315. This liquid transfer element 315 acts as a passive aerosol generator (i.e. an aerosol generator which does not use heat to form the aerosol), and is formed of a porous material. The liquid transfer element 315 comprises a conveying portion 317 and an aerosol generating portion 322, which is located in the vapour flow passage 321. In this example, the aerosol generating portion 322 is a porous nib.

When activated, as discussed in more detail below, a storage chamber 316 (defined by a tank 318) for storing a first aerosol precursor (i.e. a liquid comprising a flavourant) is fluidly connected to the liquid transfer element 315. The flavoured aerosol precursor, in this embodiment, is stored in a porous body within the storage chamber 316 (but may be a free-liquid). In the activated state, the liquid transfer element 315 is in contact with the flavoured aerosol precursor stored in the storage chamber 316 by way of contact with the porous body/free liquid.

The liquid transfer element 315 comprises an aerosol generating portion 322 and a conveying portion 317. The aerosol generating portion 322 is located at a downstream end (top of FIG. 3A) of the liquid transfer element 315, whilst the conveying portion 317 forms the remainder of the liquid transfer element 315. The conveying portion 317 is elongate and substantially cylindrical. The aerosol generating portion 322 is bulb/bullet-shaped, and comprises a portion which is wider (has a greater radius) than the conveying portion 317. The aerosol generating portion 322 tapers to a tip at a downstream end of the liquid transfer element 315.

The liquid transfer element 315 extends into and through the storage chamber 316, such that the conveying portion 317 is in contact with the contents of the storage chamber 316. In particular, an inner wall of the tank 318 defines a conduit 324, through which the liquid transfer element 315 extends. The liquid transfer element 315 and the conduit 324 are located in a substantially central position within the storage chamber 316 and are substantially parallel to a central longitudinal axis of the consumable component 303.

The porous nature of the liquid transfer element 315 means that first (flavoured) aerosol precursor in the storage chamber 316 is drawn into the liquid transfer element 315. As the flavoured aerosol precursor in the liquid transfer element 315 is depleted in use, further flavoured aerosol precursor is drawn from the storage chamber 316 into the liquid transfer element 315 via a wicking action.

Before activation, the storage chamber 316 is fluidly isolated from the liquid transfer element 315. In this example, the isolation is achieved via a plug 320 (preferably formed from silicone) located at one end of a conduit 324 surrounding the liquid transfer element 315. In other examples, the plug may be replaced by any one of: a duck bill valve; a split valve or diaphragm; or a sheet of foil.

Figure 4:
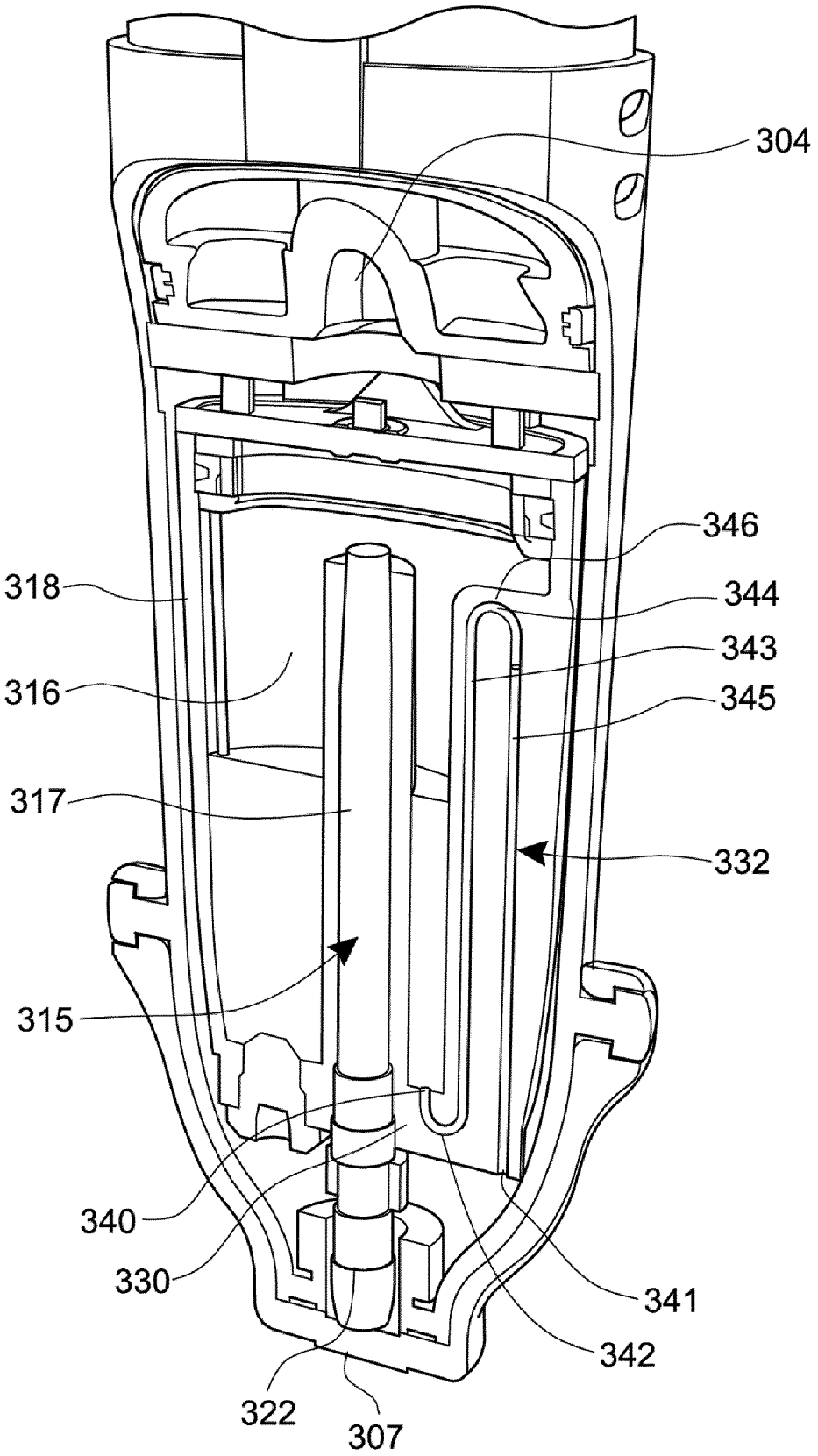
FIG. 4 shows the air bleed channel of the component in an inverted position.

The storage chamber 316 further includes an air bleed channel which is not shown in FIG. 3A but is shown in detail in FIG. 4. In the deactivated state, the air bleed channel is sealed by a sealing element in the form of a pierceable membrane (preferably made from foil). Activation (or piercing) member (not shown), which projects inwardly from the mouthpiece 309, and may take the form of a blade, pierces the pierceable membrane and opens the air bleed channel when the consumable component 303 is moved to the activated state (as is discussed in more detail below).

The aerosol generating portion 322 is located within the vapour flow passage 321 that extends through the flavour pod portion 302. The aerosol generating portion 322, by occupying a portion of the vapour flow passage 321, constricts or narrows the vapour flow passage 321. This constricted or narrowed portion of the vapour flow passage 321 defines an aerosolisation chamber 319 of the consumable component 303. The aerosolisation chamber 319, which is adjacent the aerosol generating portion 322, is the narrowest portion of the vapour flow passage 321. The constriction of the vapour flow passage 321 at the aerosolisation chamber 319 results in increased air velocity and a corresponding reduction in air pressure of the air flowing therethrough and thus may be referred to as a Venturi aperture. The aerosolisation chamber 319 is generally toroidal in shape (extending circumferentially about the aerosol generating portion 322), but this toroidal shape may include one or more interruptions where supports extend inwardly to contact the aerosol generating portion 322 and to support the aerosol generating portion 322 within the aerosolisation chamber 319.

The cartomizer portion 301 of the consumable component 303 includes a reservoir 305 (defined by a container) for storing a second (e-liquid) aerosol precursor (which may contain nicotine). A wick 311 extends into the reservoir so as to be in contact with (i.e. partially submerged in) the e-liquid aerosol precursor. The wick 311 is formed from a porous wicking material (e.g. a polymer) that draws the e-liquid aerosol precursor from the reservoir 305 into a central region of the wick 311 that is located in the vaporising chamber 325.

A heater 314 is a configured to heat the central region of the wick 311. The heater 314 includes a resistive heating filament that is coiled around the central region of the wick 311. The wick 311 and the heater 314 generally define a vaporiser, and together with the reservoir 305 act as an active aerosol generator. The vaporiser (i.e. wick 311 and heater 314) and aerosol generating portion 322 are both at least partially located within the airflow passage, with the aerosol generating portion 322 being downstream of the vaporiser.

So that the consumable component 303 may be supplied with electrical power for activation of the heater 314, the consumable component 303 includes a pair of consumable electrical contacts 313. The consumable electrical contacts 313 are configured for electrical connection to a corresponding pair of electrical supply contacts in the device (not shown). The consumable electrical contacts 313 are electrically connected to the electrical supply contacts (not shown) when the consumable component 303 is engaged with the device. The device includes an electrical power source, for example a battery.

To transition from the deactivated state (shown in FIG. 3A) to the activated state, mouthpiece 309 is moved along a central longitudinal axis 350 in an upstream direction towards cartomizer portion 301. The mouthpiece 309 is fixed by a collar 308 to the conveying portion 317 of the liquid transfer element 315 and therefore liquid transfer element 315 moves with the mouthpiece 309. The mouthpiece 309 and liquid transfer element 315 are moved relative to the tank 316.

When the mouthpiece 309 is moved upstream, an activation/piercing member (not shown) contacts and pierces a sealing element in the form of a pierceable membrane extending across the air bleed channel 332 (shown in FIG. 4) thereby fluidly connecting the vapour flow passage 321 the storage chamber 316. This allows air from the vapour flow passage 321 to enter the storage chamber 316 as aerosol precursor is removed from the storage chamber 316 by the liquid transfer element 315.

In addition to piercing of the membrane by the piercing member, liquid transfer element 315 pushes on, and moves, plug 320 out of the conduit 324 which then allows liquid transfer element 315 to come into contact with the flavoured aerosol precursor stored in the storage chamber 316. The plug 320 may then be unconstrained within the storage chamber, or may be pushed by liquid transfer element 315 into a holding location.

Once activated, and in use, a user draws (or "sucks", "pulls", or "puffs") on the mouthpiece 309 of the consumable component 303, which causes a drop in air pressure at the mouthpiece aperture 307, thereby generating air flow through the inlet opening 306, along the airflow passage, out of the mouthpiece aperture 307 and into the user's mouth.

When the heater 314 is activated by passing an electric current through the heating filament in response to the user drawing on the mouthpiece 309 (the drawing of air may be detected by a pressure transducer), the e-liquid located in the wick 311 adjacent to the heating filament is heated and vaporised to form a vapour in the vaporising chamber 325. The vapour condenses to form the e-liquid aerosol within the vapour outlet channel 323. The e-liquid aerosol is entrained in an airflow along the vapour flow passage 321 to the mouthpiece aperture 307 for inhalation by the user when the user draws on the mouthpiece 309.

The device supplies electrical current to the consumable electrical contacts 313. This causes an electric current flow through the heating filament of the heater 314 and the heating filament heats up. As described, the heating of the heating filament causes vaporisation of the e-liquid in the wick 311 to form the e-liquid aerosol.

As the air flows through the vapour flow passage 321, it encounters the aerosol generating portion 322. The constriction of the vapour flow passage 321, at the aerosolisation chamber 319, results in an increase in air velocity and corresponding decrease in air pressure in the airflow in the vicinity of the porous aerosol generating portion 322. The corresponding low pressure and high air velocity region causes the generation of the flavoured aerosol from the porous surface of the aerosol generating portion 322 of the liquid transfer element 315. The flavoured aerosol becomes entrained in the airflow and ultimately is output from the mouthpiece aperture 307 of the consumable component 303 and into the user's mouth.

The flavoured aerosol is sized to inhibit pulmonary penetration. The flavoured aerosol is formed of particles with a mass median aerodynamic diameter that is greater than 70 microns. The flavoured aerosol is sized for transmission within at least one of a mammalian oral cavity and a mammalian nasal cavity. The flavoured aerosol is formed by particles having a maximum mass median aerodynamic diameter that is less than 100 microns. Such a range of mass median aerodynamic diameter will produce aerosols which are sufficiently small to be entrained in an airflow caused by a user drawing air through the device and to enter and extend through the oral and or nasal cavity to activate the taste and/or olfactory receptors.

The e-liquid aerosol generated is sized for pulmonary penetration (i.e. to deliver an active ingredient such as nicotine to the user's lungs). The e-liquid aerosol is formed of particles having a mass median aerodynamic diameter of less than 1 micron. Such sized aerosols tend to penetrate into a human user's pulmonary system, with smaller aerosols generally penetrating the lungs more easily. The e-liquid aerosol may also be referred to as a vapour.

The size of aerosol formed without heating (in the passive aerosolisation portion) is typically smaller than that formed by condensation of a vapour (formed within the active aerosolisation portion).

Figure 3B:
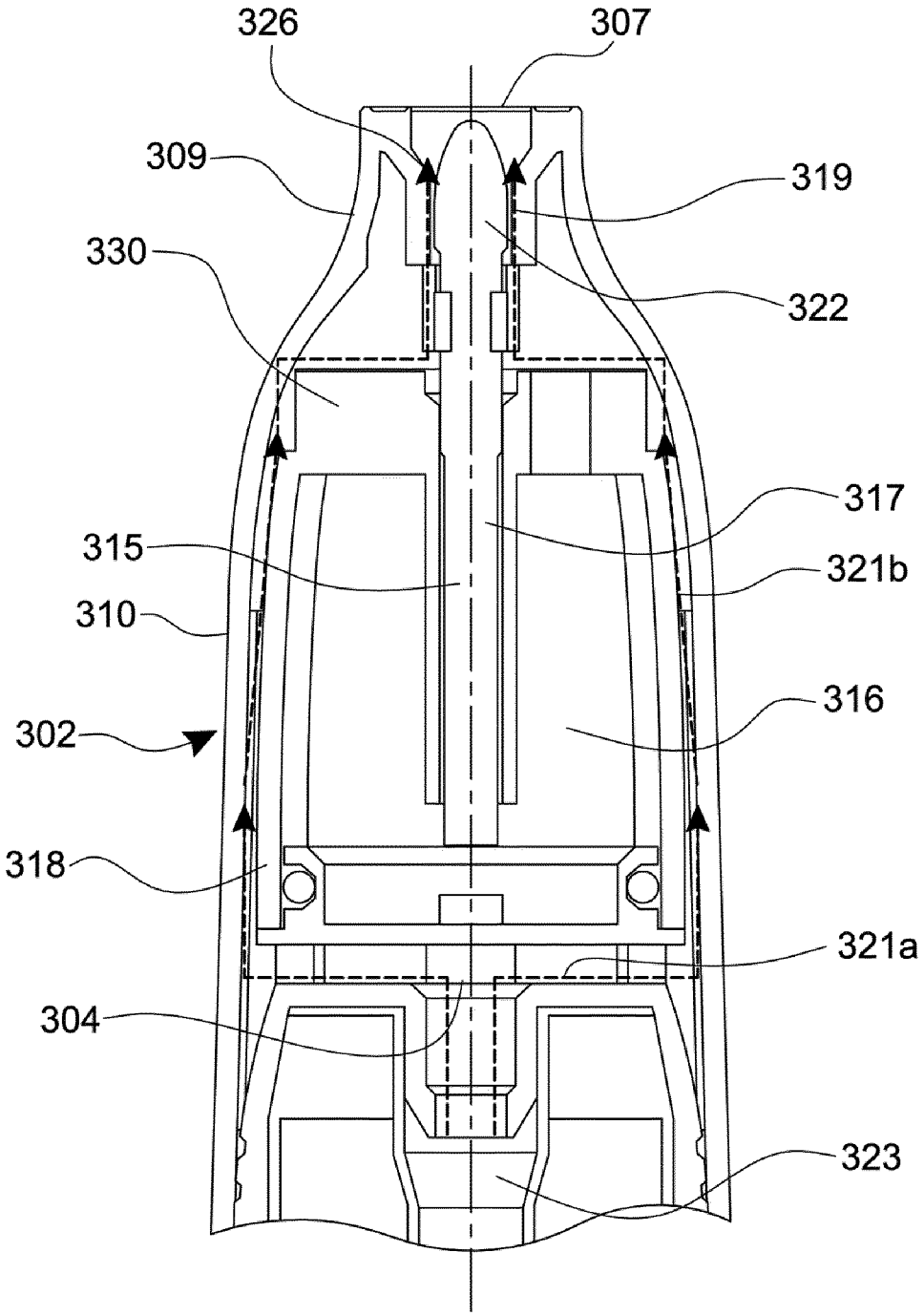
FIG. 3B is a cross-sectional schematic view of the flavour pod portion of the consumable of the third embodiment.

FIG. 3B illustrates the flow of vapour through the flavour pod portion 302 of FIG. 3A. The flavour pod portion 302 is shown in the activated state. The cartomizer portion is not shown, but it should be appreciated that the flavour pod portion 302 is engaged with the cartomizer 301 of FIGS. 3A and 3B. In other embodiments, however, the consumable component 303 may not comprise a cartomizer portion, and may provide only flavour to the user.

As is provided above, the flavour pod portion 302 comprises an upstream (i.e. upstream with respect to flow of air in use) vapour passage inlet 304 (in fluid communication with the vapour outlet channel 323) and a downstream (i.e. downstream with respect to flow of air in use) outlet in the form of a mouthpiece aperture 307. Between, and fluidly connecting the vapour passage inlet 304 and the mouthpiece aperture 307, is a vapour flow passage 321.

The vapour flow passage 321 comprises a transverse portion 321*a*. The airflow path through the device deflects at the vapour passage inlet 304 i.e. there is a deflection between the vapour outlet channel 323 and the transverse portion 321*a* of the vapour flow passage 321.

The vapour flow passage 321 then deflects again from the transverse portion 321*a* to a longitudinal portion 321*b* which extends generally longitudinally between a device housing 310 (which is integral with the mouthpiece 309) and the tank 318. The vapour flow passage deflects again at the upper wall 330 of the tank 318 within the mouthpiece 309, through the aerosolisation chamber 319, towards the mouthpiece aperture 307.

The vapour flow passage 321 may be a single (annular) flow passage around the tank 318 or it may comprises two braches which split around the tank 318 and re-join within the mouthpiece 309 proximal the liquid transfer element 315.

A transition surface 326, between the aerosolisation chamber 319 and the mouthpiece aperture 307 flares outwardly in the downstream direction, such that a diameter of the mouthpiece aperture 307 is greater than a diameter of the aerosolisation chamber 319.

In use, when a user draws on the mouthpiece 309, air flow is generated through the air flow passage through the device. Air (comprising the e-liquid aerosol from the cartomizer portion 301 as explained above with respect to FIG. 3A) flows through the vapour outlet channel 323 and into the vapour passage 321. Further downstream, as air flows past the aerosol generating portion 322 in the aerosolisation chamber 319, the velocity of the air increases, resulting in a drop in air pressure. As a result, the flavoured aerosol precursor held in the aerosol generating portion 322 becomes entrained in the air so as to form the flavoured aerosol. The flavoured aerosol has the particle size and other properties described above with respect to FIG. 3A.

As the flavoured aerosol precursor becomes entrained within the air, the liquid transfer element 315 transfers further flavoured aerosol precursor from the storage chamber 316 to the aerosol generating portion 322. More specifically, the liquid transfer element wicks the flavoured aerosol precursor from the storage chamber 316 to the aerosol generating portion 322.

Figure 3C:
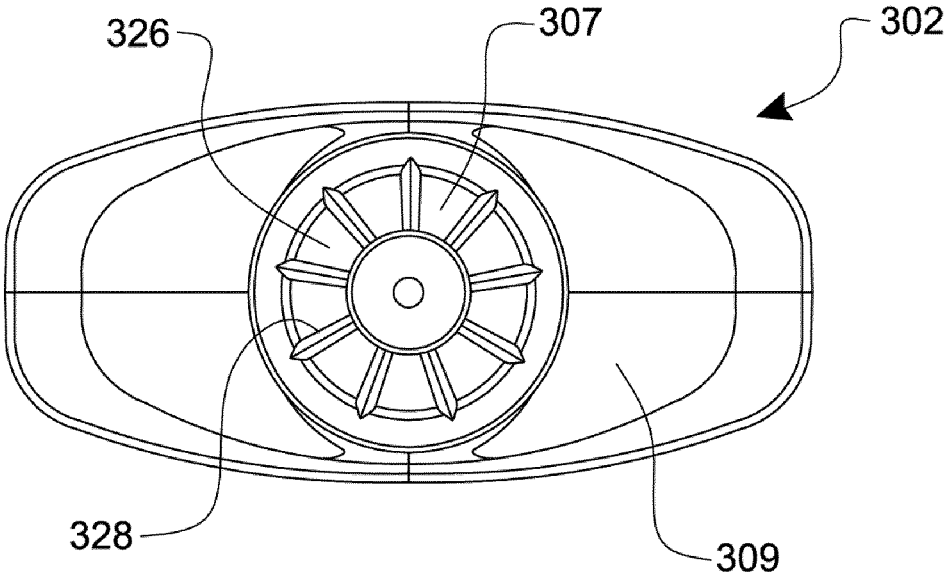
FIGS. 3C and 3D are respective top and perspective views of a mouthpiece of the third embodiment.
Figure 3D:
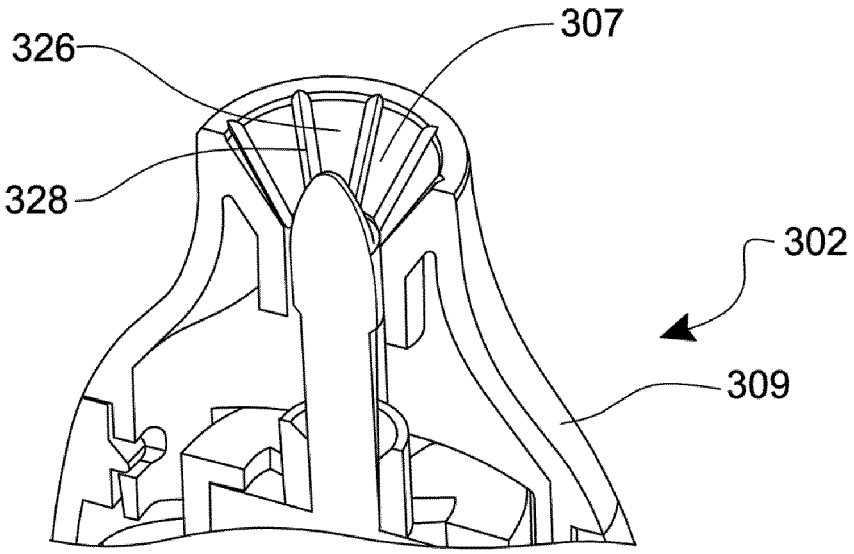

FIGS. 3C and 3D show further views of the flavour pod portion 302 which highlight features of the mouthpiece 309. Many of the reference numerals of FIG. 3B are omitted from FIGS. 3C and 3D for clarity.

An uneven inner (transition) surface 326 is located between the mouthpiece aperture 307 and the aerosolisation chamber 319. In the present example, the inner surface 326 has the form of a substantially frustoconical surface, but includes grooves or channels 328 to make the inner surface 326 somewhat uneven. In other examples, the inner surface 326 may have another form (for example, the form a substantially cylindrical surface), and may include any type of protrusion or groove to make the inner surface uneven.

The inner surface 326 is angled with respect to an axial direction (i.e. relative to a central axis extending from a base of the consumable to the mouthpiece) such that the diameter of the passage 321 proximate the mouthpiece aperture 307 increases in the downstream direction. The inner surface 326 is downstream of the aerosolisation chamber 319 of the vapour flow passage 321.

The grooves 328 are generally V-shaped in cross-sectional profile, and extend in the axial direction for the full length of the inner surface 326. Each groove 328 is formed from a pair of surfaces angled at between 30 and 90 degrees (e.g. 60 degrees) relative to each other. The grooves 328 have a depth (measured normal to the inner surface 326) of at least 0.2 mm (e.g. at least 0.4 mm). The grooves 328 have a depth of less than 0.8 mm (e.g. less than 0.6 mm). The grooves have a depth of substantially 0.5 mm. The inner surface 326 comprises 9 grooves 328, but may comprise more or less grooves.

The grooves 328 are spaced apart from each other by substantially 1 mm at the downstream end of the inner surface 326. In other examples, the spacing at the downstream end of grooves or protrusions may be selected such that it is equal to or less than the mass median diameter (as described above) of particles in the flavoured aerosol.

The inner surface 326 comprises a smooth polished surface between the grooves 328. Polishing the surface in this way may provide improved aerodynamic properties. However, in other examples, the inner surface 326 may be textured. In such examples, the texture of the surface may provide the uneven surface, and no grooves may be required.

In use, the uneven nature of the inner surface 326 may make it easier for droplets to form on the inner surface 326, preventing large droplets from entering the user's mouth. The grooves 328 may help to channel the large droplets back into the consumable.

FIG. 4 shows the component in an inverted position with the mouthpiece aperture 307 as the vertically lowest point of the component. An air bleed channel 332 extending from an outside channel opening 341 outside of the tank 318 to an inside channel opening 340 within the tank 318/storage chamber 316 is provided. This will also be present in the embodiments shown in FIGS. 3A-3D but is not shown in those figures for clarity.

The air bleed channel comprises an s-bend channel formed of a first bend portion 342 comprising a smooth continuous deflection through 180 degrees proximal the inside channel opening 340. The bleed channel also comprise a first substantially linear portion 343 extending from the first bend portion 342 to a crown portion 344 comprising a second smooth continuous deflection through 180 degree. A second substantially linear portion 345 extends from the crown portion 344 to the outside channel opening 341.

The linear portions 343, 345 are substantially parallel to one another and substantially parallel to the longitudinal axis of the component.

In the inverted orientation of the component as shown in FIG. 4, the crown portion 344 is vertically spaced above the inside channel opening 340 (and above the first bend portion 342) and aligned in a horizontal direction with the upstream end of the conduit 324 enclosing the conveying portion 317 of the liquid transfer element 315.

The linear portions 343, 345 and the crown portion 344 are formed within an elongate body 346 which extends within the storage chamber 316 and is integrally formed with the inner surface of the tank 318 and the upper wall 330 of the tank.

The channel openings 340, 341 and the first bend portion are formed within the tank upper wall 330. The outside channel opening 341 is radially outwards of the inside channel opening 340. The outside channel opening 341 is distal the liquid transfer element 315 i.e. it is radially closer to the outside surface of the tank 318/mouthpiece component 309 than to the liquid transfer element 315.

The linear portions of the bleed channel may extend (e.g. longitudinally) within the storage chamber.

In an upright (use) orientation, as the volume of the flavoured liquid in the storage chamber 316 reduces, air flows from the outside channel opening 341 to the inside channel opening 340 along a flow path extending in an upstream (vertically downwards) direction to the crown portion 344 and then in a downstream (vertically upwards) direction to the first bend portion 342 before entering the storage chamber 316 at the inside opening 340.

The air bleed channel 332 has a volume that is greater than 11.5% that of the volume of the storage chamber 316. In the embodiment shown, the storage chamber 316 has a volume of 0.9 mL (i.e. it can accommodate a maximum volume of 0.9 mL liquid aerosol precursor). Thus the air bleed channel has a minimum volume of 115 $mm^3$.

Upon inversion of the component 302, flavoured liquid will enter the bleed channel 332 through the inside channel opening 340 and will extend within the channel 332 e.g. within the first bend portion 342 and first linear portion 343. In the event of a temperature increase (e.g. an increase in temperature as may occur when the component is held within a user's pocket), the increase in volume of the flavoured liquid within the bleed channel 332 (resulting from an increase in volume in the air trapped within the storage chamber 316/tank 318) can be accommodated within the bleed channel 332 e.g. within the crown portion 344/second linear portion 345 as shown in FIG. 4. Capillary action helps retain the flavoured liquid within the air bleed channel 332 in the inverted orientation such that leakage from the outside channel opening 341 is prevented.

Assuming: a storage chamber 316 volume of 0.9 mL; a first aerosol precursor liquid comprising around 15% ethanol (with a volumetric expansion coefficient of 0.00109 I/C) and 85% propylene glycol (with a volumetric expansion coefficient of 0.00057 I/C); ideal behaviour (according to Charles' Law) of air expansion', the following air bleed channel volumes as percentages of storage chamber volume (0.9 mL) were calculated in various temperature change scenarios.

| | Fill level | Liquid precursor expansion/mL | Air expansion/mL | Minimum volume of liquid bleed channel/$mm^3$ | Volume as percentage of storage chamber volume |
|---|---|---|---|---|---|
| Scenario 1 - office to pocket 20-35° C. | Full | 0.0087 | 0.0000 | 9 | 1.0 |
| | Half full | 0.0044 | 0.0230 | 27 | 3.0 |
| | Nearly depleted | 0.0000 | 0.0461 | 46 | 5.1 |

-continued

| | Fill level | Liquid precursor expansion/mL | Air expansion/mL | Minimum volume of liquid bleed channel/mm$^3$ | Volume as percentage of storage chamber volume |
|---|---|---|---|---|---|
| Scenario 2 - office to car 20-50° C. | Full | 0.0175 | 0.0000 | 17 | 1.9 |
| | Half full | 0.0087 | 0.0461 | 55 | 6.1 |
| | Nearly depleted | 0.0000 | 0.0922 | 92 | 10.2 |
| Scenario 3 - cold car to pocket 0-35° C. | Full | 0.0204 | 0.0000 | 20 | 2.3 |
| | Half full | 0.0102 | 0.0577 | 68 | 7.5 |
| | Nearly depleted | 0.0000 | 0.1154 | 115 | 11.5 |

Thus it can be seen that an air bleed channel having a volume of 11.5% the volume of the storage chamber 316 will be able to accommodate a 35° C. change in temperature without leakage of the liquid aerosol precursor.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention as defined in the claims.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. An aerosol delivery component comprising:

a tank defining a storage chamber for storing a first liquid aerosol precursor, an air bleed channel extending from an outside channel opening outside of the tank to an inside channel opening within the tank, wherein the air bleed channel comprises an s-bend channel for retaining the first liquid aerosol precursor in an inverted orientation of the aerosol delivery component, wherein the tank comprises an upper wall extending transverse to a longitudinal axis of the aerosol delivery component and the inside channel opening and the outside channel opening are formed in the upper wall.

2. The aerosol delivery component according to claim 1 wherein the air bleed channel comprises a first bend portion extending from the inside channel opening and a crown portion comprising a second bend portion wherein the crown portion is vertically spaced above the first bend portion in the inverted orientation.

3. The aerosol delivery component according to claim 2 wherein the first bend portion and the crown portion are vertically spaced by a first substantially linear portion with a second substantially linear portion extending from the crown portion to the outside channel opening.

4. The aerosol delivery component according to claim 3 wherein the first and second linear portions are substantially parallel to a longitudinal axis of the aerosol delivery component.

5. The aerosol delivery component according to claim 3 wherein the tank comprises an elongate body extending longitudinally within the storage chamber on an inside surface of the tank and wherein the first and second substantially linear portions of the air bleed channel extend within the elongate body.

6. The aerosol delivery component according to claim 2, further comprising an aerosol generator comprising a porous liquid transfer element having a conveying portion and an aerosol generating portion and wherein the tank comprises a conduit extending from the upper wall, the conveying portion extending within the conduit, wherein the crown portion of the bleed channel is substantially aligned in a horizontal direction with an upstream end of the conduit.

7. The aerosol delivery component according to claim 6 wherein the aerosol generator is a passive aerosol generator configured to generate a first aerosol from the first liquid aerosol precursor without the application of heat.

8. The aerosol delivery component according to claim 1 further comprising a container defining a reservoir for storing a second liquid aerosol precursor and a vaporiser for vaporising the second liquid aerosol precursor to form a second aerosol, wherein a flow passage extends from the vaporiser past the outside opening of the air bleed channel.

9. The aerosol delivery component according to claim 1 wherein the outside channel opening is radially outwards of the inside channel opening.

10. An aerosol delivery device system comprising the aerosol delivery component according to claim 1 and a device comprising a power source.

11. A method of operating an aerosol delivery system comprising inserting the aerosol delivery component according to claim 1 into a device comprising a power source.

12. An aerosol delivery component comprising:

a tank defining a storage chamber for storing a first liquid aerosol precursor, an air bleed channel extending from an outside channel opening outside of the tank to an inside channel opening within the tank, wherein the air bleed channel has a volume of at least 1% the volume of the storage chamber, wherein the tank comprises an upper wall extending transverse to a longitudinal axis of the aerosol delivery component and the inside channel opening and the outside channel opening are formed in the upper wall.

13. The aerosol delivery component according to claim 12 wherein the air bleed channel has a volume of greater than 5% of the volume of the storage chamber.

14. The aerosol delivery component according to claim 13 wherein the air bleed channel has a volume of greater than 10% of the volume of the storage chamber.

15. The aerosol delivery component according to claim 12 wherein the air bleed channel comprises an s-bend channel for retaining the first liquid aerosol precursor in an inverted orientation of the aerosol delivery component.

16. The aerosol delivery component according to claim 15 wherein the bleed channel comprises a first bend portion extending from the inside channel opening and a crown portion comprising a second bend portion wherein the crown portion is vertically spaced above the first bend portion in the inverted orientation.

17. The aerosol delivery component according to claim 12 further comprising a container defining a reservoir for storing a second liquid aerosol precursor and a vaporiser for vaporising the second liquid aerosol precursor, wherein a flow passage extends from the vaporiser past the outside opening of the air bleed channel.

18. The aerosol delivery component according to claim 12 wherein the outside channel opening is radially outwards of the inside channel opening.

19. An aerosol delivery device system comprising the aerosol delivery component according to claim 12 and a device comprising a power source.

20. A method of operating an aerosol delivery system comprising inserting the aerosol delivery component according to claim 12 into a device comprising a power source.

* * * * *